US005809722A

United States Patent [19]

Bertsche

[11] Patent Number: 5,809,722

[45] Date of Patent: Sep. 22, 1998

[54] GIRDER SUPPORTED REINFORCED CONCRETE SLAB BUILDING STRUCTURES WITH SHEARING CONNECTORS, AND METHODS OF CONSTRUCTING THE BUILDING STRUCTURES AND CONNECTORS

[75] Inventor: Peter Bertsche, Prackenbach, Germany

[73] Assignee: Keith M. Wright, Eugene, Oreg.

[21] Appl. No.: 795,674

[22] Filed: Feb. 6, 1997

[51] Int. Cl.[6] ..... E04B 5/16; E04B 5/43

[52] U.S. Cl. ..... 52/334; 52/262; 52/299; 52/331; 52/333; 52/335; 52/341; 52/351; 52/600; 52/630; 52/687; 52/737.3

[58] Field of Search ..... 52/327, 328, 331, 52/332, 333, 334, 335, 340, 341, 677, 679, 687, 600, 602, 730.1, 737.3, 351, 251, 262, 299, 630, 368, 376, 649.1, 649.8

[56] References Cited

U.S. PATENT DOCUMENTS

| | | | |
|---|---|---|---|
| 2,163,889 | 6/1939 | Podd et al. . | |
| 2,358,147 | 9/1944 | Colburn . | |
| 2,760,450 | 8/1956 | Findleton | 52/730.7 X |
| 3,528,209 | 9/1970 | Schillinger | 52/368 X |
| 3,736,716 | 6/1973 | Nishimura | 52/334 |
| 4,597,233 | 7/1986 | Rongoe, Jr. | 52/334 |
| 4,628,654 | 12/1986 | Boswel . | |
| 4,811,770 | 3/1989 | Rapp . | |
| 5,509,243 | 4/1996 | Bettigole et al. | 52/334 |
| 5,561,957 | 10/1996 | Gauthier . | |
| 5,634,308 | 6/1997 | Doolan | 52/730.7 X |

FOREIGN PATENT DOCUMENTS

| | | | |
|---|---|---|---|
| 164109 | 2/1949 | Austria | 52/335 |
| 80682 | 7/1951 | Czechoslovakia | 52/334 |
| 726897 | 11/1931 | France . | |
| 1005710 | 4/1957 | Germany | 52/334 |
| 591804 | 8/1947 | United Kingdom | 52/334 |
| 2053308 | 2/1981 | United Kingdom | 52/334 |
| WO 94/11589 | 5/1994 | WIPO | 52/600 |

OTHER PUBLICATIONS pp. 747–749 –German publication showing shear connectors.

pp. 779–785 –German publication showing shear connectors.

*Primary Examiner*—Carl D. Friedman
*Assistant Examiner*—Laura A. Callo
*Attorney, Agent, or Firm*—Reising, Ethington, Learman & McCulloch, PLLC

[57] ABSTRACT

Reinforced concrete slab and girder building structures incorporate shearing connectors with lengthwise support parts to which lengthwisely spaced, transversely extending, rigid load transfer plates affix. A girder structure having one or more lengthwisely extending girders is provided and the shear connectors are fixed to the girders near their support walls below a deck for supporting the slab, the shearing connectors being positioned so that portions of the load transfer plates and support parts project above the girder structure and deck to receive compression forces in the slab which are transferred by the connectors to the girders. The lengthwisely extending connector support parts have connections for carrying a series of lengthwisely spaced rebar rods which embed in the slab when it is poured and transfer compressive load forces to the transfer plates.

29 Claims, 14 Drawing Sheets

GIRDER SUPPORTED REINFORCED CONCRETE SLAB BUILDING STRUCTURES WITH SHEARING CONNECTORS, AND METHODS OF CONSTRUCTING THE BUILDING STRUCTURES AND CONNECTORS

BACKGROUND OF THE INVENTION

This invention relates to reinforced concrete slab building structures wherein shearing connectors are used to transfer compression loads from the slab directly to an underlying girder structure. Coupling induced bending stresses are countered in the system to be described and vertical disengagement of the concrete slab from the girder system is resisted.

While my novel connector system is particularly suited to transferring compression forces in the concrete slab due to the load of the slab itself, as well as those imposed by loads which are placed upon the slab, to underlying wood beam girders, a second structural system is also disclosed wherein the underlying girder structure employs steel I-beams.

U.S. Pat. No. 4,628,654, which I incorporate herein by reference, is directed to a so-called composite floor structure, wherein underlying, upwardly open steel channel beams are employed which are filled with concrete when the slab is poured, and wherein a series of spaced apart transverse connector plates are employed at spaced intervals over the length of the channel beams. The disclosure in this patent relates to what is termed a reinforced concrete floor slab formed integrally with a plurality of horizontally disposed concrete filled and concrete encapsulated steel channel members.

Other prior constructions, referenced in the aforesaid U.S. Pat. No. 4,628,654, mention a structure with I-beam girders in which the upper flanges of the I-beam girders are embedded in the concrete slab, and another construction in which the I-beams are provided along their tops with a series of shear resisting members which are spaced longitudinally along the length of the I-beam and secured thereto.

Prior art U.S. Pat. No. 4,628,654 does not consider nor seek to solve the problems which are encountered when the underlying girder structure consists of wood beams.

SUMMARY OF THE INVENTION

The present invention is concerned with a girder supported, reinforced concrete slab building structure incorporating shearing connectors. Such concrete floors are cast or poured, and cured, on decks resting upon spaced apart girders which span the vertical building support walls. The building walls may be studded wood frame walls or masonry walls, for example, and the wood girders contemplated may be solid timber beams or glued laminated beams to which the wood decking is secured. The wood decking may be tongue and groove boards or plywood decking, or fashioned from other suitable material and, normally, a parting layer, such as a plastic sheet, is used on top of the decking between the decking and the slab.

Novel shearing connectors are used to transfer the compressive load forces present in the concrete slab directly to the underlying support girders or beams, and these are provided at the ends of the beams and do not extend the full length of the girder beams. Typically, the particular shearing connectors used depend upon the compressive forces which need to be transferred from the reinforced slab into the girder or beams, keeping in mind that the shearing connectors of the present invention are used near the supported sections of the girders or beams to resist shearing forces and counter bending moments. The excellent results obtained are possible whether wood beams or steel beams are employed in the girder system or assembly.

It is to be understood that the invention to be described was developed in the first place for wood girder beams. A steel beam girder structure is also secondarily disclosed which utilizes a related shearing connector system which secures to the upper flange of an I-beam girder and, similarly, extends through the upper decking and the plastic parting layer to embed within the concrete slab. In each instance, connections or passages for the rebar rods are provided in the shearing connectors such that the rebars transfer compressive stresses to the connectors for transmission to the girder beams. These connections are uniformly spaced lengthwisely along the connectors and are disclosed as constituting openings of a size to snugly receive the rebar rods which extend transversely in the slab crosswisely of the connectors.

One of the prime objects of the present invention is to provide a building structure of the character to be described in which the shearing connectors do not extend the full length of the underlying girders.

Still another object of the invention is to provide a building construction incorporating shearing connectors between the slab and girders which accommodate reinforcing rods in a manner such that load is transferred from the rods to the transversely disposed end plates of the connectors, which then impose the load crosswisely to the girder beam length.

Still another object of the invention is to provide a building structure of the character described in which the shearing connectors transfer the bending stresses directly to the wood beam girder structure disclosed crosswisely to the grain of the wood.

Still another object of the invention is to provide a building structure of the character disclosed wherein the connectors which transfer the load are embedded in the concrete slab, and are so constituted as to provide compression load resistant enclosures in the slab which are filled with concrete during the pouring of the slab.

Still another object of the invention is to provide a building structure of the character described wherein a composite flooring structure functions to very efficiently and reliably transfer slab compression loads directly to the underlying girder system.

Still another further object of the invention is to provide a building structure of the type described which is relatively economical to construct using shearing connectors which can be factory assembled, and need not be fabricated on the job.

These and other objects, advantages and features of the present invention will become more apparent from the following detailed description when taken together with the accompanying drawings.

THE DRAWINGS

FIG. 10 is a side elevational view depicting a more elongate shearing connector which is used in two bay frame structures;

FIG. 11 is a similar side elevational view showing the still more elongated shearing connector which is used in three bay frame structures;

Figure 13:
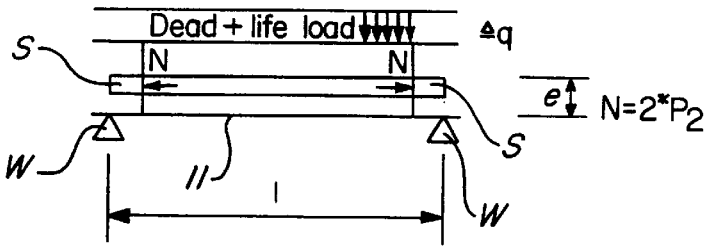
FIG. 13 is a schematic load system view illustrating the load forces applied.
Figure 13A:
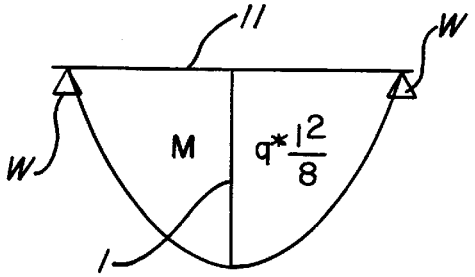
Figure 13B:
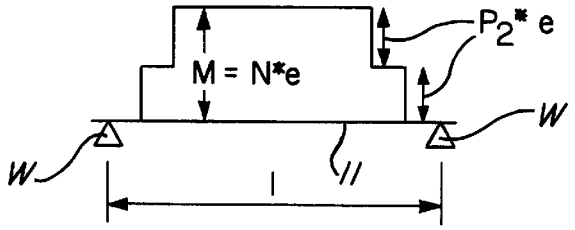
Figure 13C:
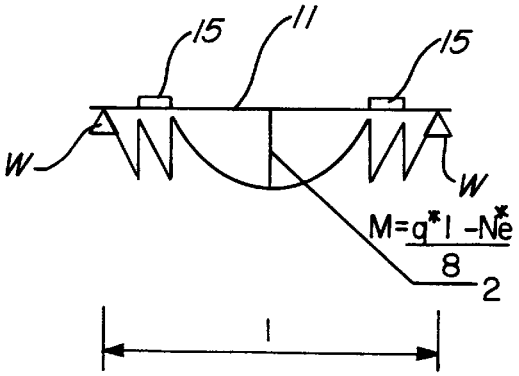
Figure 13D:
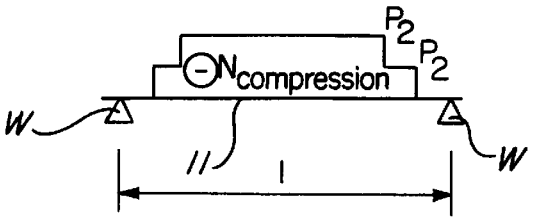

FIG. 13*a* is a graphical illustration the bending moment for a simple girder;

FIG. 13*b* is a bending moment graphical illustration for the present invention;

FIG. 13*c* is a similar view for a girder with forces applied in accordance with the present system;

FIG. 13*d* is a graphical representation of compressive forces in the slot.

Figure 13E:
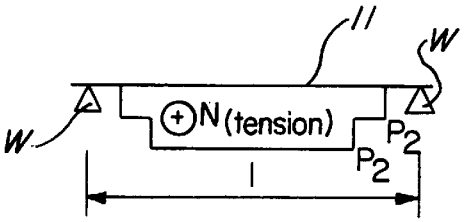

FIG. 13*e* is a graphical representation of tension force in the girder.

Figure 14:
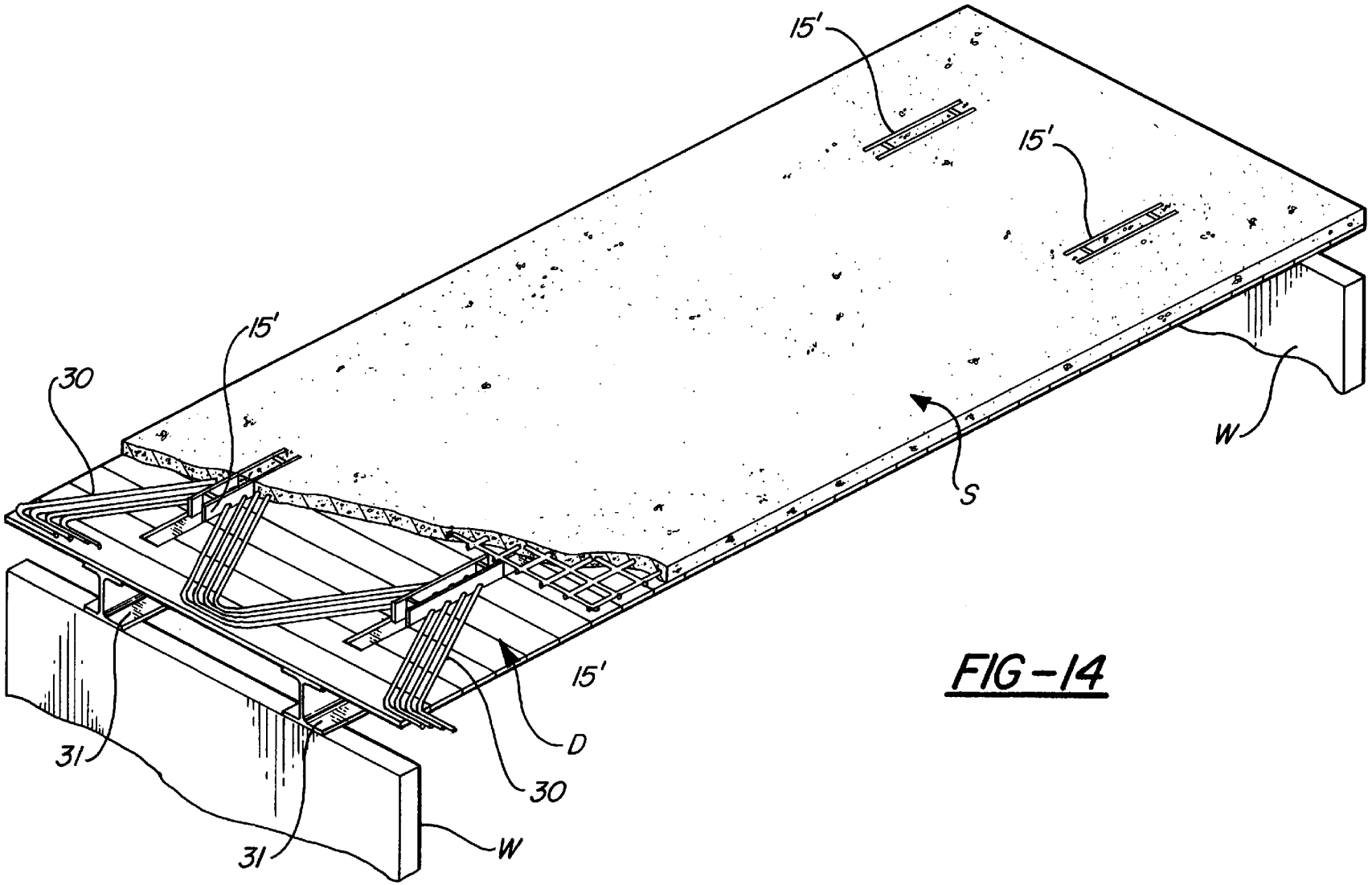
Figure 15:
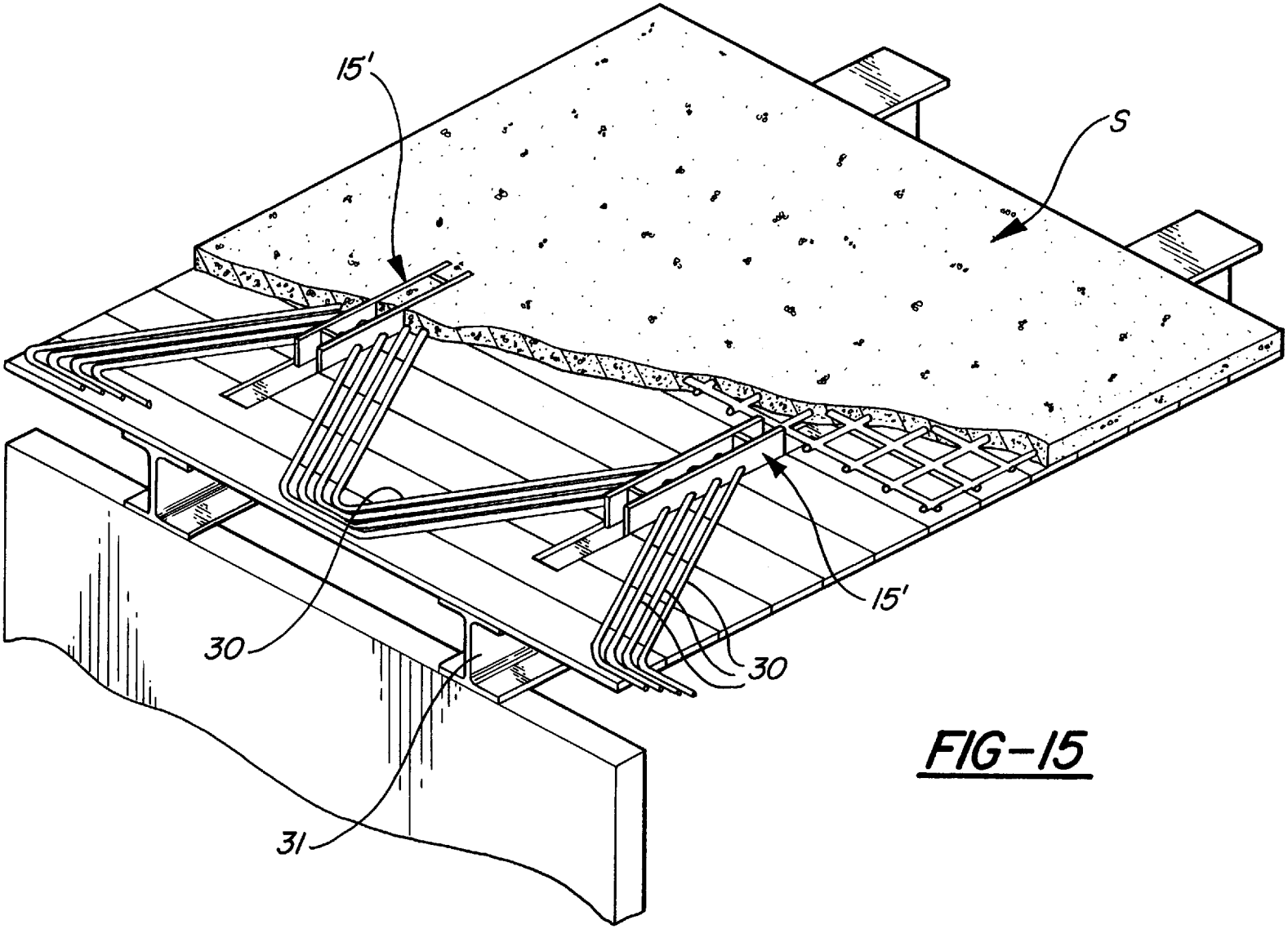
Figure 16:
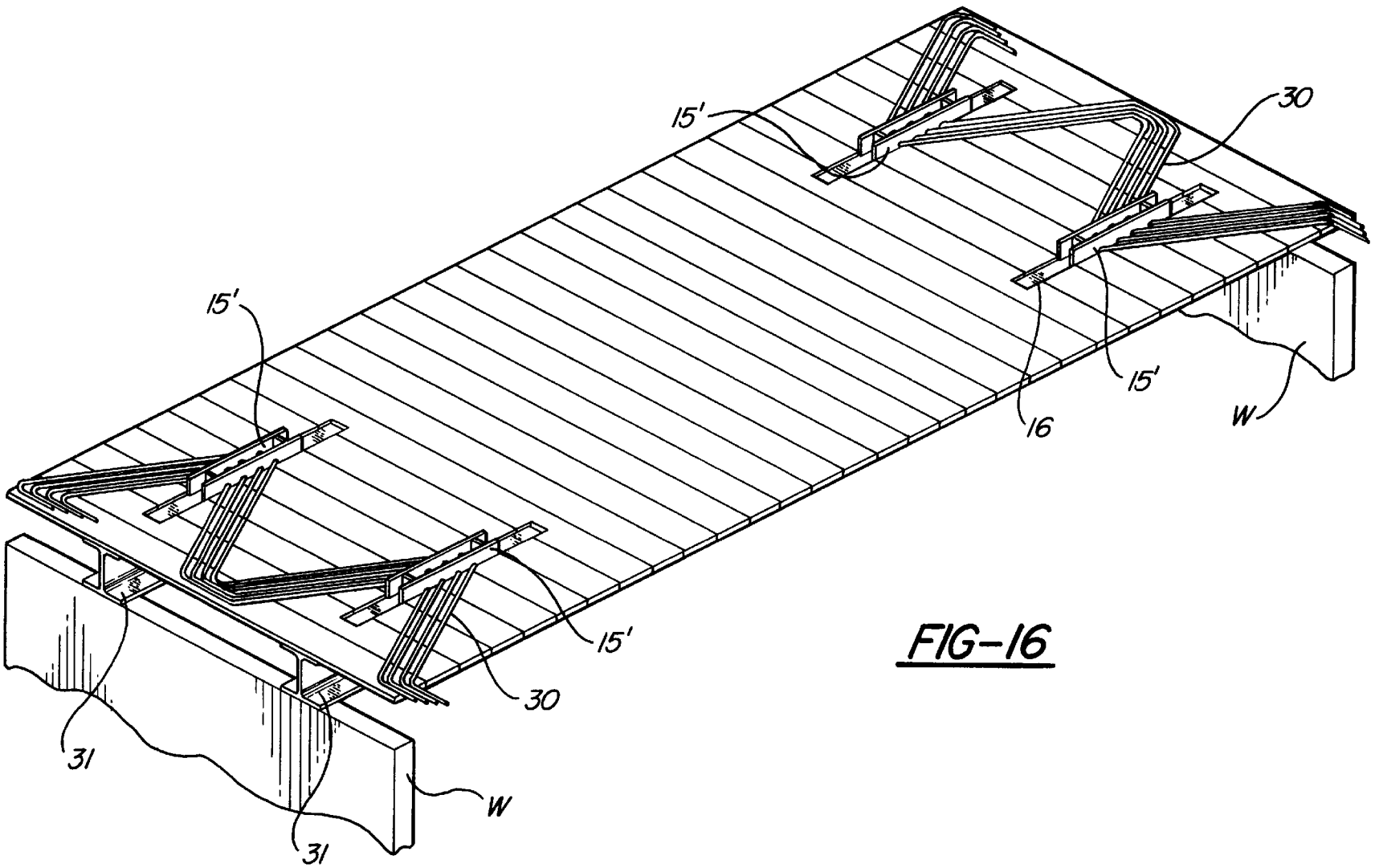
Figure 17:
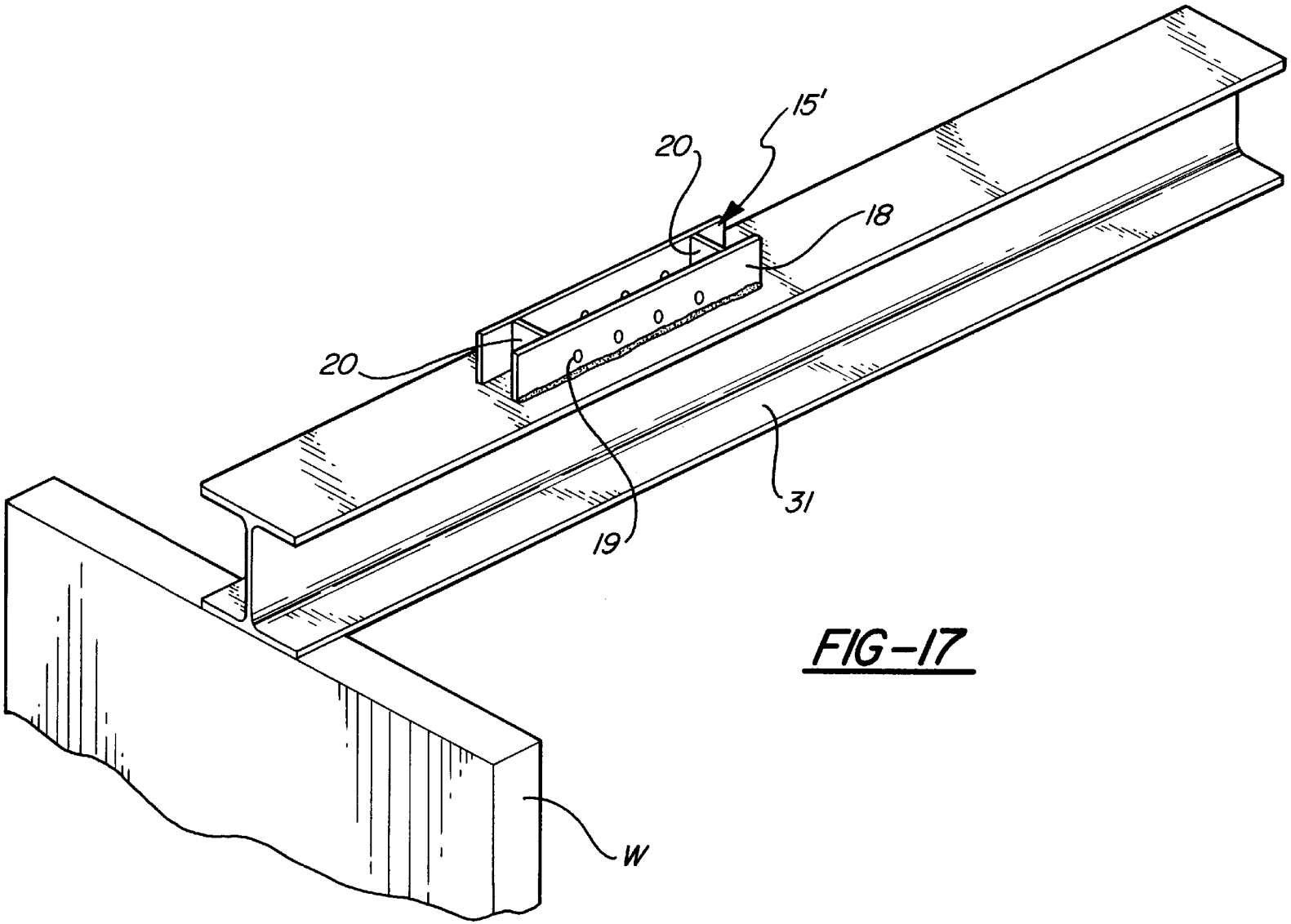
Figure 18:
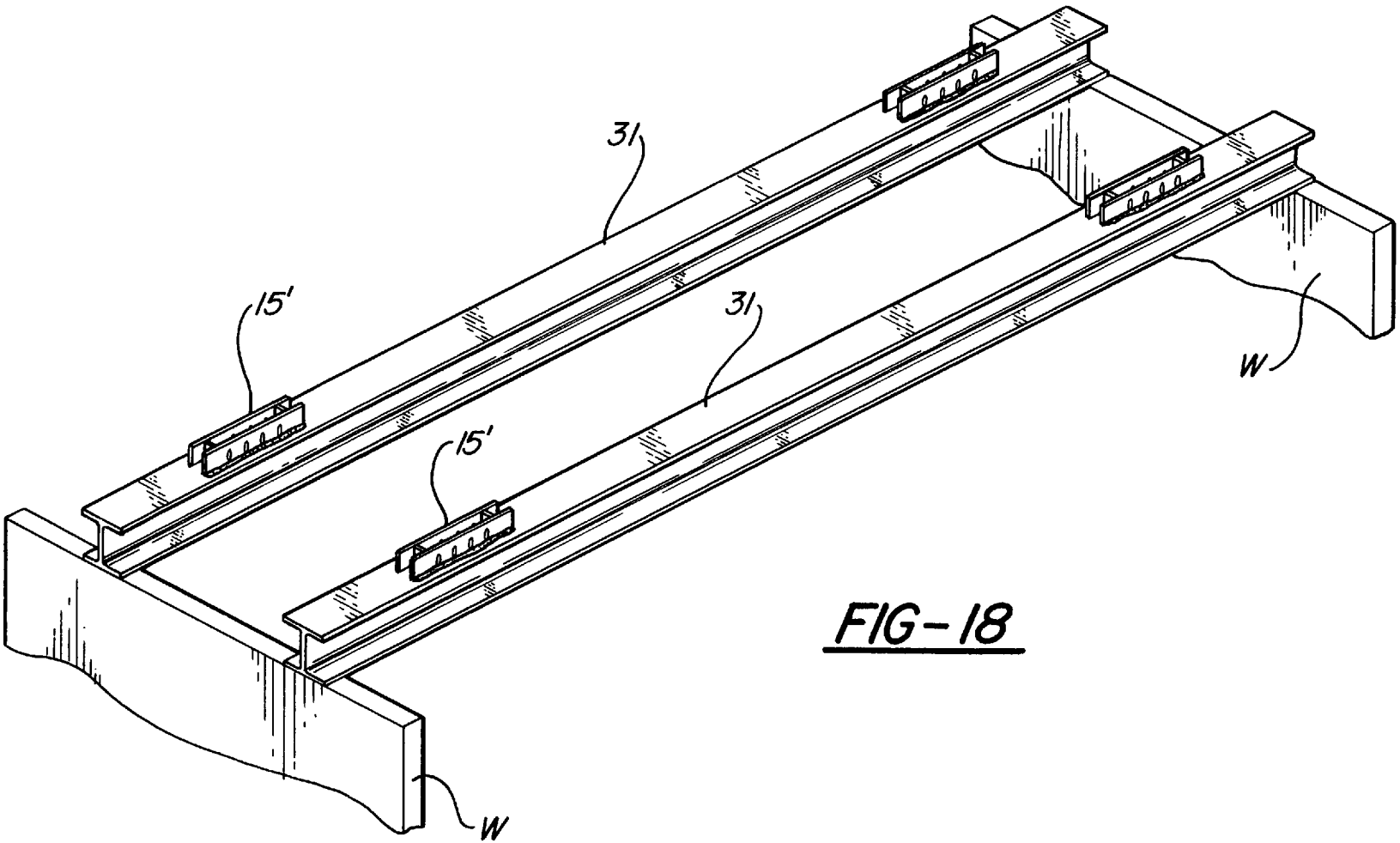
Figure 19:
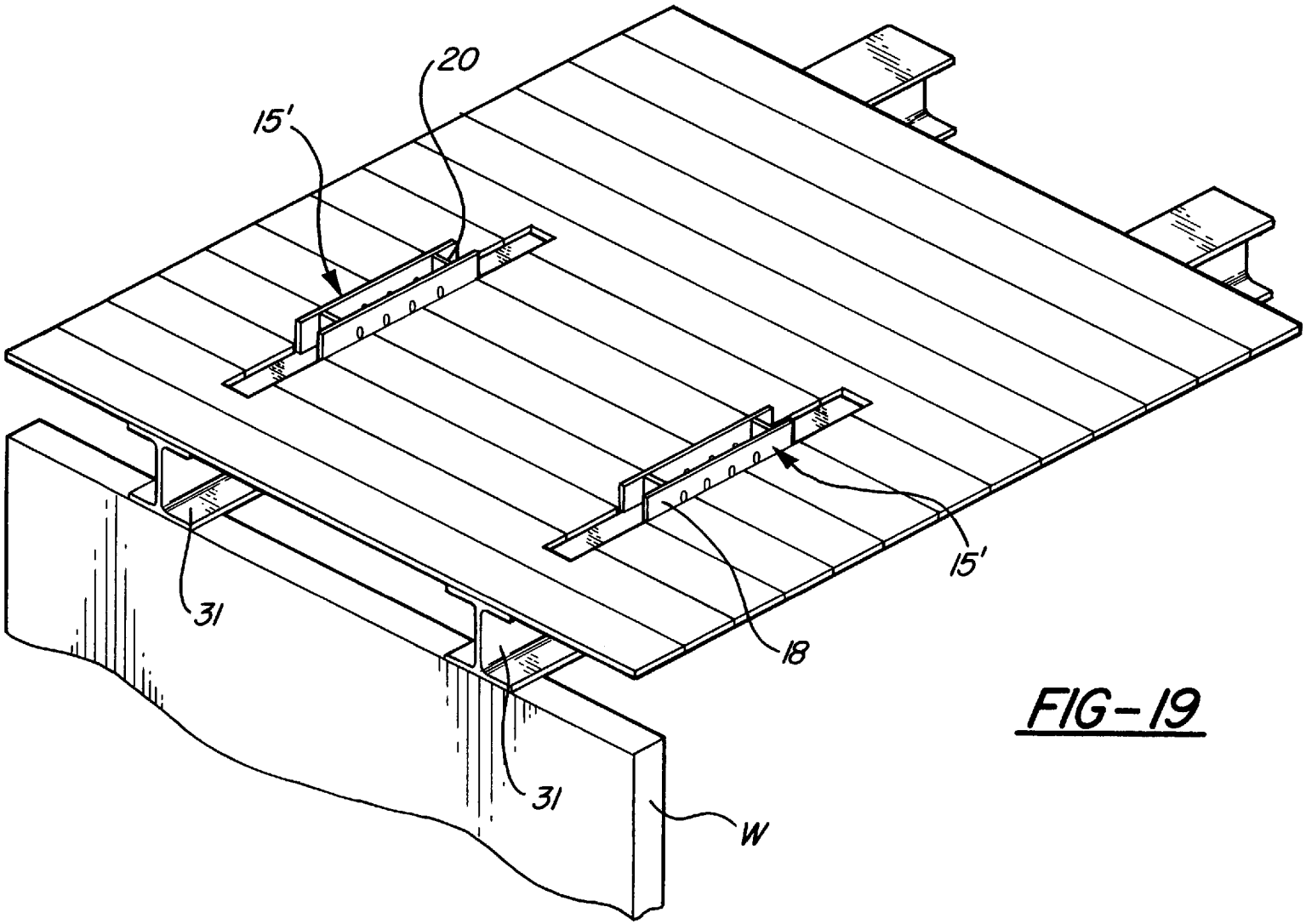

FIG. 14 is a schematic, perspective, elevational view of a related building structure in which I-beams are used in the girder system in place of the formerly used wood beams;

FIG. 15 is a similar fragmentary view on a slightly enlarged scale;

FIG. 16 is a similar view with the concrete slab removed;

FIG. 17 is a schematic, fragmentary perspective view showing one of the girders with the connector fixed to the upper surface of the I-beam girder;

FIG. 18 is a similar isometric view showing the connectors fixed in position on the I-beams; and FIG. 19 is a similar perspective elevational view in which wood decking has been partially applied to the underlying I-beam girder system.

DETAILED DESCRIPTION OF THE DRAWINGS

Referring now, more particularly, to the accompanying drawings and in the first instance to FIGS. 1–12 wherein I have illustrated a construction in which the underlying girder supports are wood beams, a letter W indicates vertical supporting walls forming a part of the building structure which I have generally designated BS. The wood beams which make up the underlying girder system or assembly, generally designated GS, include wood beams 10 (FIG. 2) connecting the wood beams 11 which extend from one wall W to the other wall W.

Figure 2:
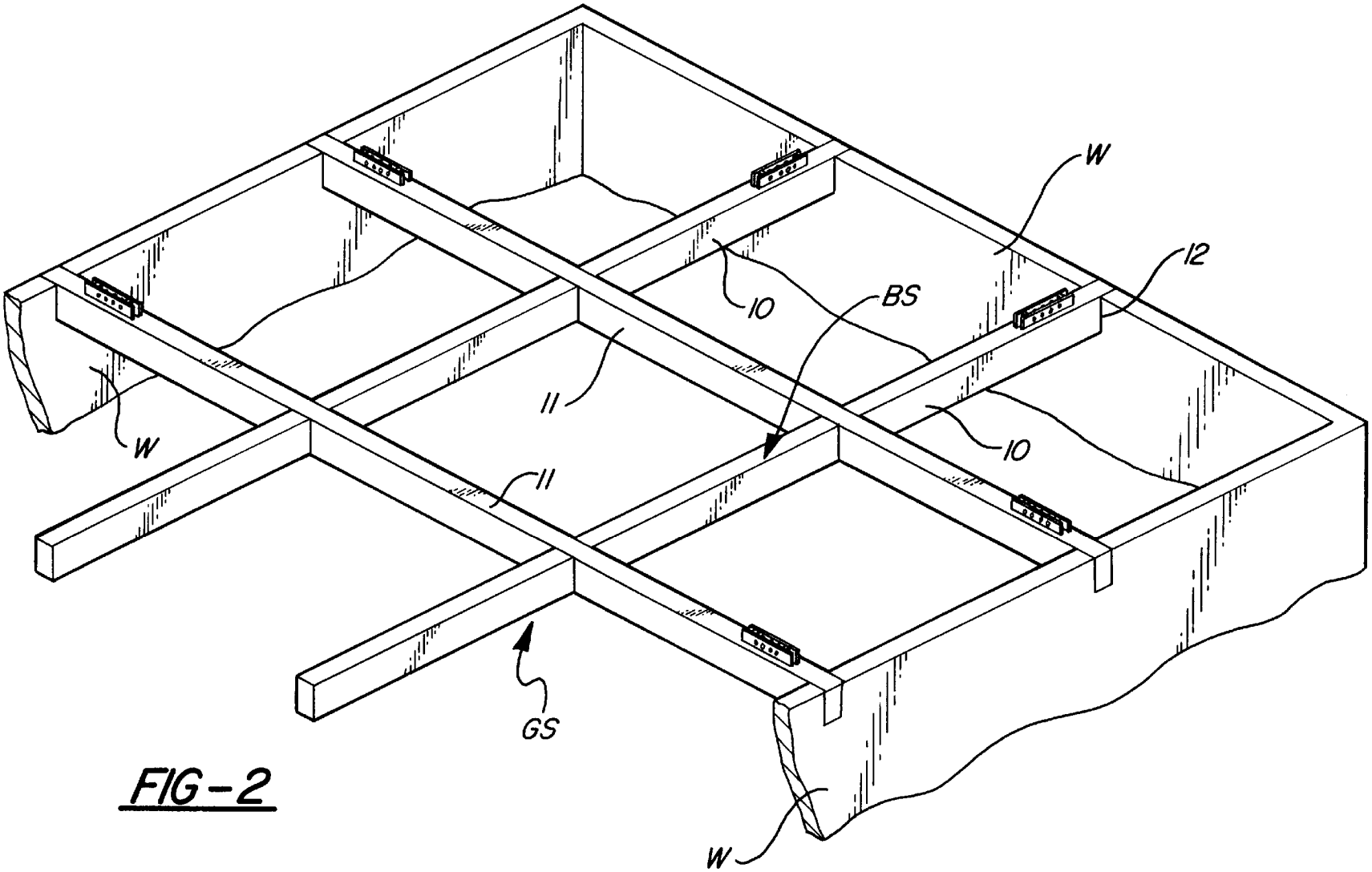
FIG. 2 is a similar fragmentary schematic view of the underlying girder structure with the shearing connectors shown fixed in position, the view being of the underlying girder and support wall system only.
Figure 4:
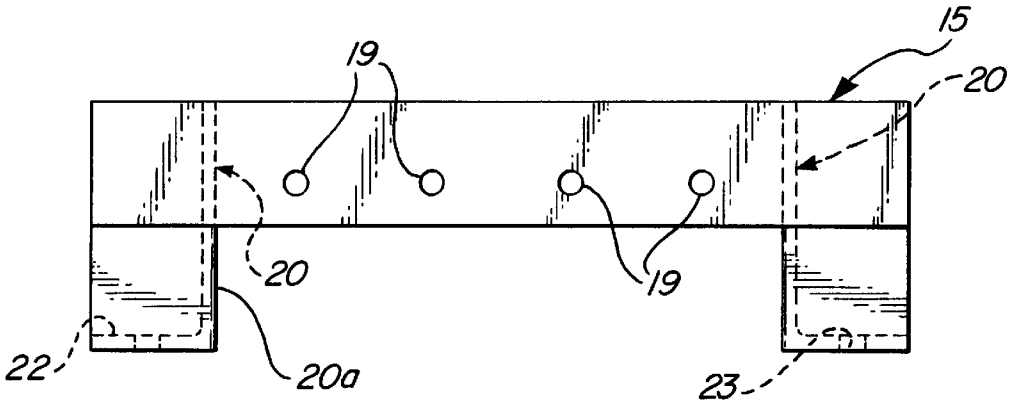
FIG. 4 is an enlarged front elevational view thereof.
Figure 6:
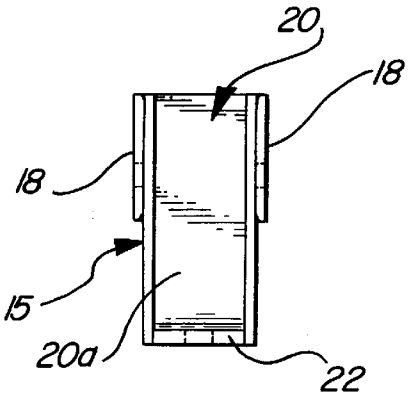
FIG. 6 is an end elevational view of the shearing connector shown in FIG. 4.

In FIG. 2, the wood beams 10 and 11 are shown as received in cutouts or recesses 12 provided in the walls W. The support walls W can be wood or masonry walls, or poured concrete walls, or made up of any other desired material. The beams 10 and 11 may be solid timber beams or adhesively joined laminated or other wood beams.

Figure 1:
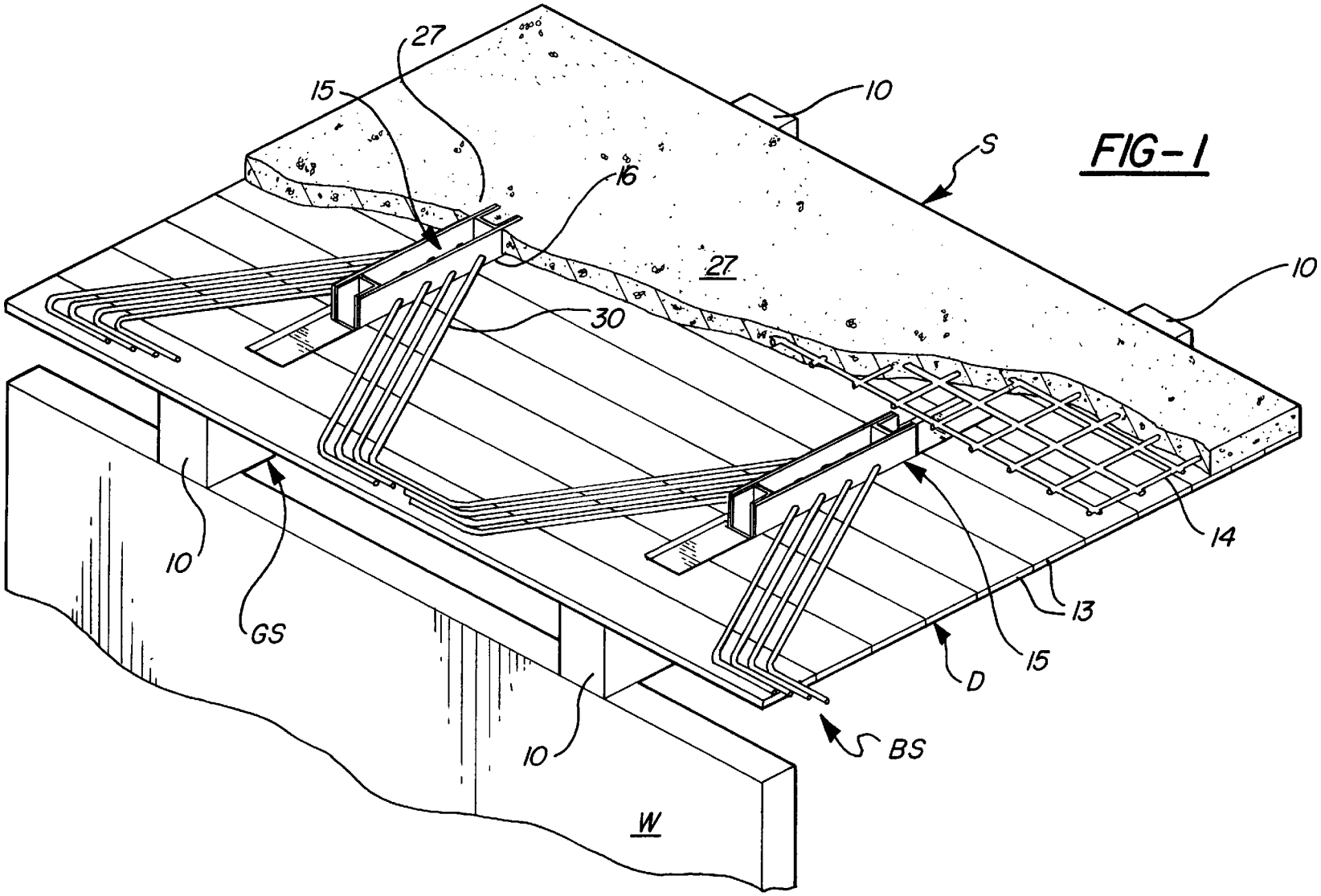
FIG. 1 is a schematic fragmentary, sectional perspective plan view of the building structure with various components broken away to illustrate underlying elements of the structure.

In FIG. 1, the reinforced concrete slab, generally designated S, is shown as covering a wood deck or decking, generally designated D, which may be made up of side by side, preferably tongue and groove connected boards 13. Other materials may alternately be used, but the wood boards or planks 13 preferentially nail readily to the underlying beams 10 and 11. The concrete slab S is a reinforced concrete slab in which there is a wire reinforcement mesh 14 formed of suitable rebar steel rods or rebar-like load transfer members welded in mesh configuration.

As FIG. 13 indicates, the concrete slab S, which typically is on the order of typically four to six inches in thickness, is subjected to a dead load, which is the weight of the concrete, and a live load, which is variable dependent upon the weights which are borne by the slab S. These dead and applied loads create compressive stresses in the concrete slab S which need to be relieved by transferring them to the underlying girder system GS, without imposing them on the decking D. This is accomplished by using specially formed shearing connectors, generally designated 15, which extend upwardly from the beams 10 and 11 through slotted openings 16 provided in the wood decking D and become embedded in the concrete slab S when the latter is poured or cast.

In FIG. 13*a*, the bending moment for a single girder 11 of length L between walls W, whether it be of wood or steel construction, is portrayed. FIG. 13*c* indicates the reduced amplitude configuration of the bending moment when shearing connectors 15 are used in the matter disclosed in FIGS. 1 and 2, for example. With the shearing connectors provided at (i.e. adjacent) the wall supported ends or portions of the beams, as shown, the better results achieved with the use of the shearing connectors 15 to be described are evident from a comparison of FIGS. 13*a* and 13*c* by comparing the amplitudes of the bending moments or shear stresses along the girder or beam. The maximum amplitude at bending line 1 in FIG. 13*a* is greatly reduced to the magnitude of line 2 in FIG. 13*c* when connectors 15 are used. Diagrams 13, 13*b*, 13*d* and 13*e* are load diagrams which contemplate load application at the connector 15 locations. The shearing connectors 15, which are specially formed, rigid metal devices, i.e. welded steel elements, will be available in different sizes or configurations depending on the shear forces which need to be transferred from the reinforced slab to the underlying girders.

Figure 3:
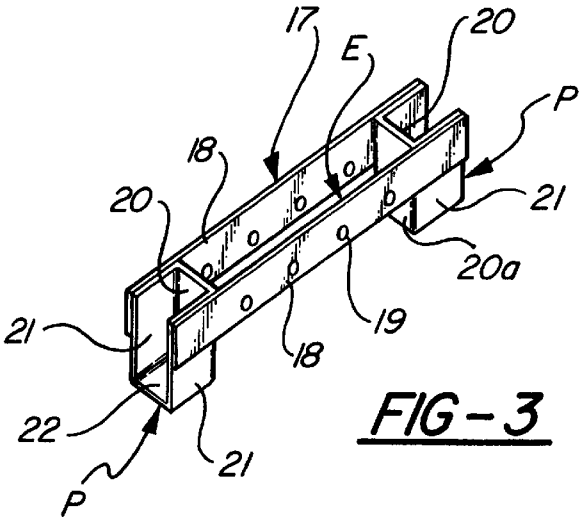
FIG. 3 is an isometric view of a shearing connector which is used in a one bay frame.
Figure 5:
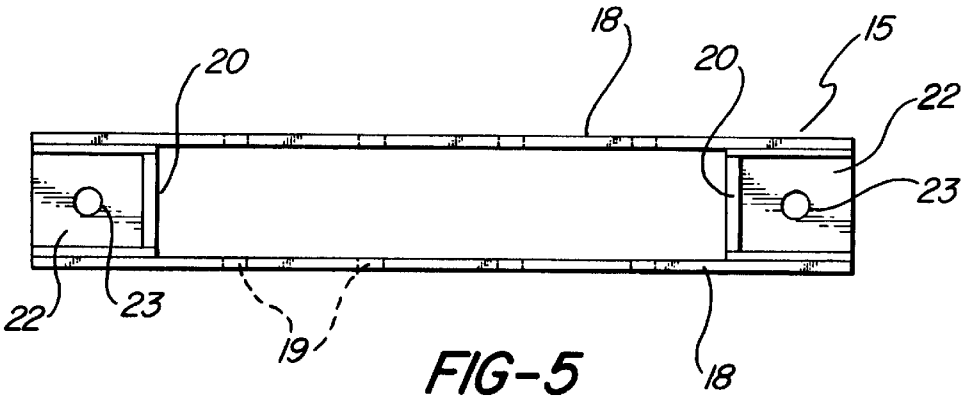
FIG. 5 is a top plan view of the connector shown in FIG. 4.

Referring now, more particularly, to FIGS. 3–6, a one bay shearing connector includes a lengthwisely extending, horizontal frame or frame component, member or element, generally designated 17, which as shown comprises transversely spaced apart side plates 18. While the plates 18 are preferred, other possibilities are the use of a channel or annular or polygonal members, either tubular or solid. The plate system 18 is preferred because it can be readily provided with transversely aligned reinforcing rod or rebar openings 19 in lengthwisely spaced relation, and, when the concrete slab is cast, the enclosure, generally designated E, formed between the plates 18, will fill with concrete to capture and encapsulate the reinforcement rods, rebars, rebar-like members, or load transfer members which extend snugly through openings 19 and function to further reinforce the concrete slab S. Welded or otherwise securely fixed to the sideplates 18, are shear load transfer web or end plates 20 which are inset from the ends of the plates 18 as shown to form the end walls of enclosure E, and which have portions or sections 20*a* projecting below the plates 18. The side plates 18 also have downwardly projecting portions or sections 21 which project with the plates 20 and, it will noted, that there are bottoms or bottom walls or plates 22 which span the projecting side plates portions 21 and the projecting web plate sections 20*a* and fix thereto, as for example, by welding them in position. The plates 21, 22, and 20–20*a* form open ended end compartments, as FIG. 3 illustrates. The bottoms 22 are provided with fastener openings 23 for receiving fasteners 25 which may typically comprise a wood screw or a bolt.

Figure 7:
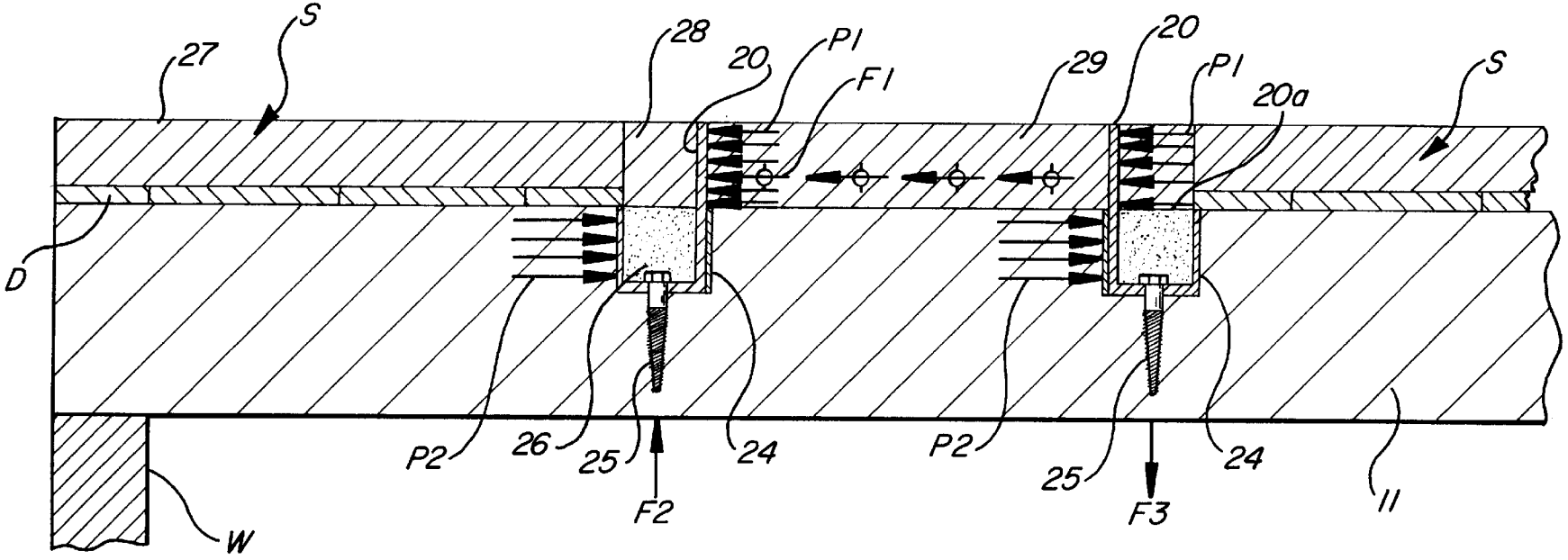
FIG. 7 is a schematic, fragmentary, sectional, elevational view of one end of a building structure having a wood beam girder system, the arrows illustrating force application and force resistance.

With reference now, more particularly, to FIG. 7, it will be noted that pockets 24 are provided in the wood beam or girder 10 or 11, as the case may be, to receive the downwardly projecting portions of the connector provided by members 21, 22 and 20*a*. When the end downward compartment projections, generally designated P, are received within the pockets 24, the plates 18 extend along the upper surface of the beam 11 as shown in FIG. 8, for example, and the fasteners 25 are fixed in the beam 11 to resist any tendency of the shearing connector 15 to raise, and to counter the couple formed as illustrated in FIG. 7 by the arrows F2 and F3.

Generally a polyethylene or other plastic parting sheet PS is used between the decking D and the concrete slab S, and this plastic sheet will have cutouts corresponding to the cutouts 16 in deck D.

Once the pockets 24 have been cut in the beam 10 or 11, as the case may be, to the configuration of the projections P of the shearing connector 15, and the downwardly projecting end portions P snugly inserted in the pockets 24 and securely fastened by the fasteners 25, the pockets 24 are filled with a cementitious grout compatible with the concrete used in the slab so as to bond thereto. The expanding grout employed is compression force resistant when cured, and does not shrink or swell in its cured state so that its installed volume does not change. The grout is one which can be purchased and mixed on-site, and, for example, may be the grout designated 1000-1 marketed by Quick-mix Sonderprodukt GmbH & Co. in Germany. A generally cementitious product of this type is preferred over other possible resinous alternatives such as epoxy products.

Figure 8:
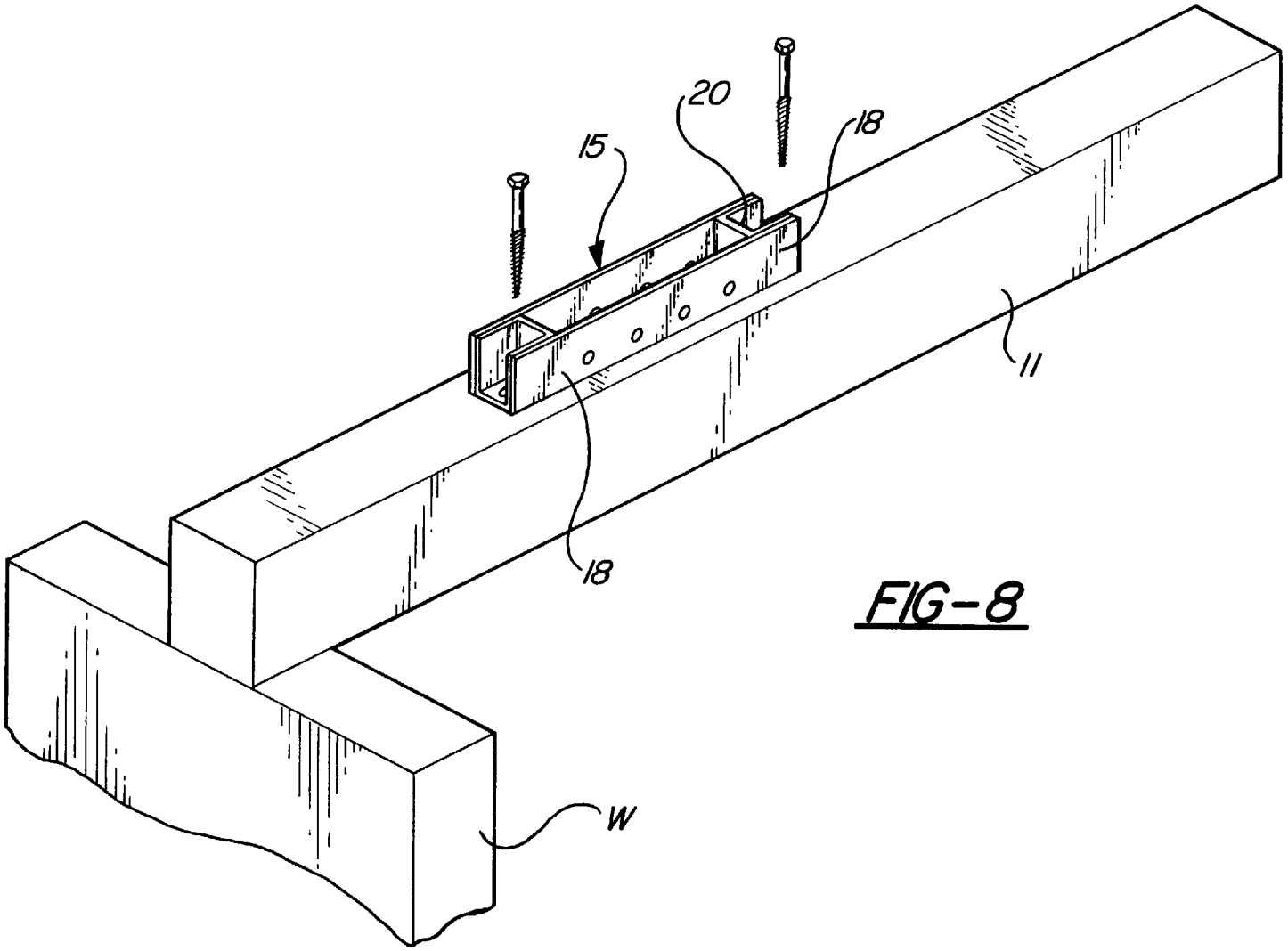
FIG. 8 is an enlarged perspective partly exploded plan view schematically showing shearing connector applied to an underlying wood beam girder.
Figure 9:
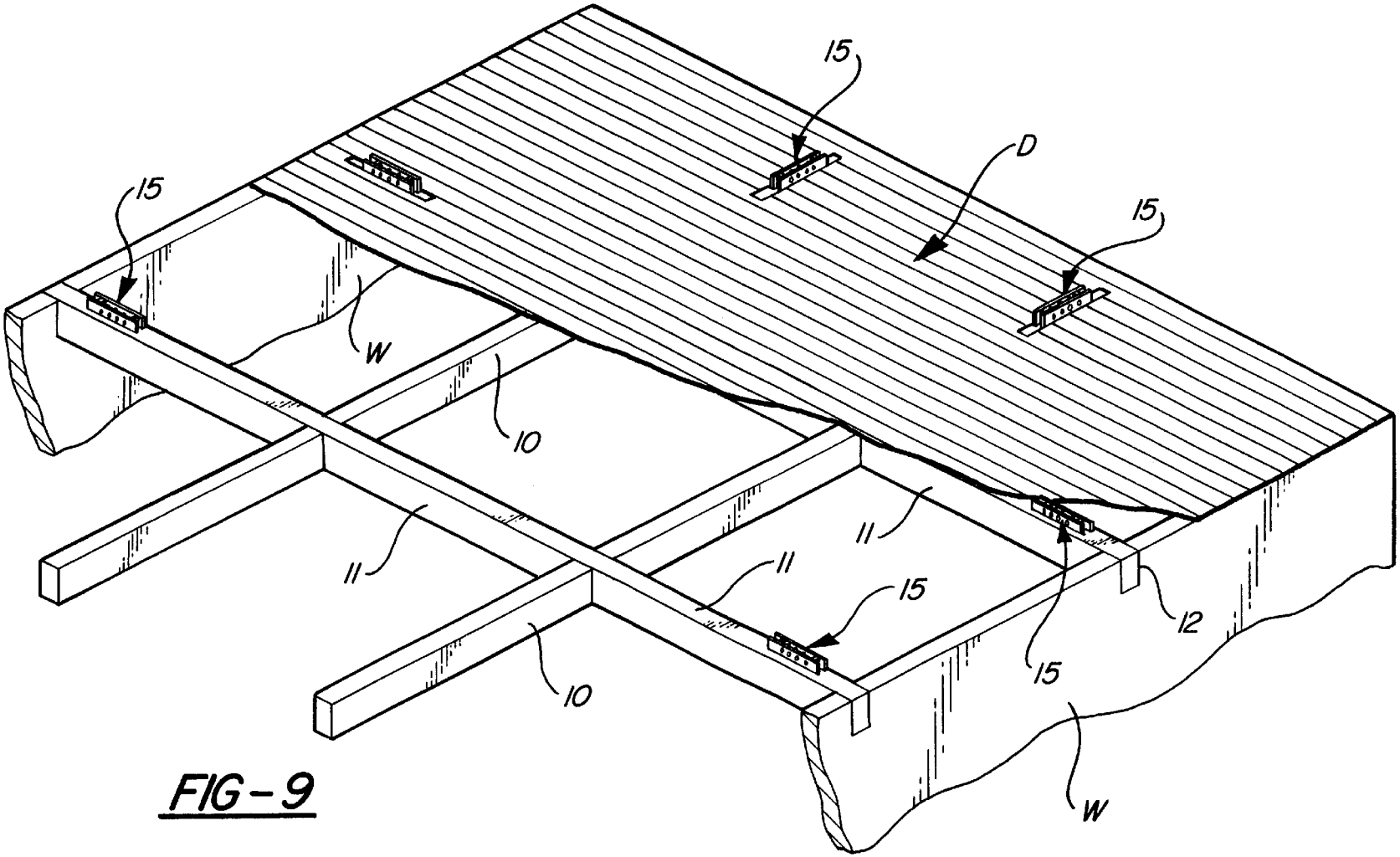
FIG. 9 is a reduced scale perspective plan view illustrating the application of wood decking to the girder system.

With the shearing connectors 15 all in place, as shown in FIG. 8, the wood decking D may be nailed in position in the manner indicated in FIG. 1, and the slab S then poured, after the parting sheet PS is also positioned. The concrete slab, generally designated S, is made up of surrounding portions 27 which embed the side plates 18 in the slab, as well as the portions 28 which fill the connector end compartments above the grout portions 26, and the portions 29, which are received in the central enclosures E of each connector 15 between the side plates 18 and web or end plates 20.

The reinforcement rods or load transfer rebar-like members 30, may preferably include generally U-shaped portions, as shown in FIG. 1, or may be linear. The steel reinforcing rods or load transfer members 30 are sized and configured to the shape of the openings 19 in the plates 18 so as to be snugly received therein and to embed within the concrete portions 29, as well as in the slab portions 27. They maybe formed in the U-shaped configuration shown in FIG. 1. The ends of the bars or rods 30 pass through the openings 19 and are received within the concrete portions 29 of the slab S to be rigidly held in position.

THE OPERATION

As particularly shown in FIG. 7, the compressive forces P1 transfer from the slab S to the transversely disposed load transfer plates or webs 20 which are rigid or what might be termed "bending stiff", so that they are not bent under the stress of the forces P1. The dimensions indicated in FIGS. 4–6 will, for example, provide this rigidity. The reinforcement or load rods 30 also transfer compressive stresses to the left end plate 20 in FIG. 7 in view of their snug reception in the openings 19. From the plates 20, the shearing forces P1 due to compression load transfer through the grout 26 in pockets 24 to impose their forces, without slippage, by end grain compression on the girder 10 or 11 as the case may be and subject the girder to tension forces. The bending moment out of the eccentric points of load application is taken up by the force couple, F2 and F3, indicated in FIG. 7.

As FIG. 2 illustrates the compression resistant concrete slab S connects to the tension resistant girders 10 and 11 only at selected locations adjacent to the wall W supports and the two materials, concrete and wood, are not connected between these shearing connections. Thus the two materials act completely separately in this context. Typically, for a thirty foot girder the pockets 24 will be cut in the beam 10 or 11 a distance of about 2 feet (L-1) from each end of the beam, the next one then being cut a distance of 2L(L-2)+1 inch from each end of the beam. FIGS. 10 and 11 illustrate related appropriate distances for the longer connectors with additional downward projections P, as will be noted.

In FIG. 7 the wood beam 11 typically will be one foot in height and one half foot in length and a single shearing connector 15 may typically transfer a 200,000 pound compression force to the beam from a slab S which typically may have a depth of 4 inches. Because plates 18 rest on the beam 11 the degree and level of interfacing embedment of the discontinuous connectors 15 in slab S is controlled. The compressive forces are concentrated by the connectors 15 and applied perpendicularly to the grain of the wood beams.

FIGS. 10 and 11 designate shearing connectors which are used for two bay and three bay frames, respectively, and it will be noted that the parts remain the same and function in the same way, except that in FIG. 10, three web plates 20 and three downwardly projecting projections P are disclosed, whereas in FIG. 11 four web plates 20 and four downwardly projecting projections P are disclosed.

With particular reference to FIG. 2, it is to be understood that the compressive forces transferred to each end of the beam 11 are applied in opposite directions from the center of the beams where the shear stress is greatest and the forces are exerted outwardly toward the walls W or locations of support.

Figure 12:
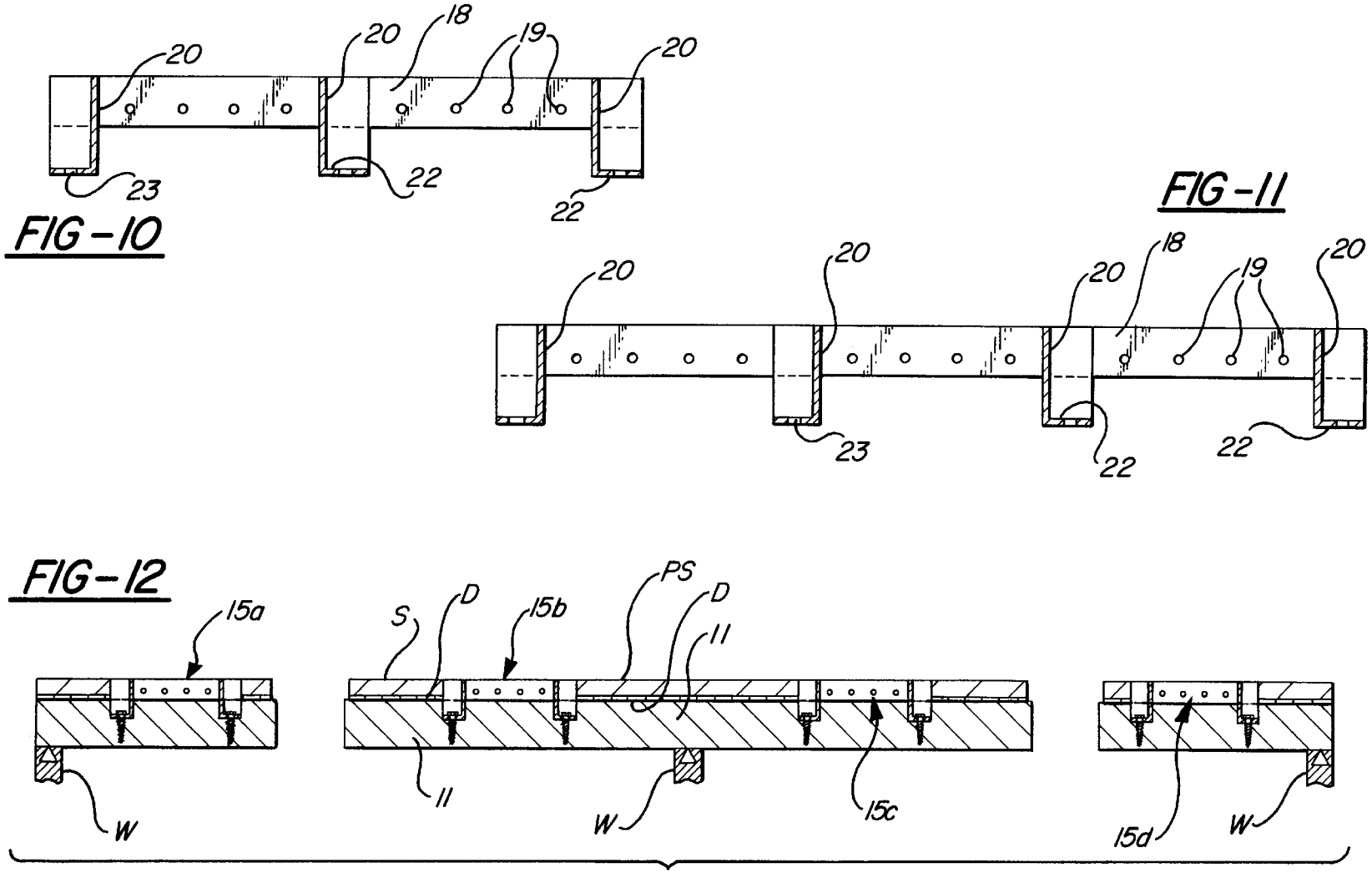
FIG. 12 is a schematic sectional elevational view showing shearing connectors in use in a two span girder system.

In FIG. 12, a so-called continuous beam system is illustrated wherein wood girder beam 11 is supported by three walls W. In this construction, shearing connectors 15, 15*a*, 15*c*, and 15*d* are provided adjacent the locations of support as previously. In FIG. 12, the compressive forces applied to shearing connector 15*a* is applied in an opposite direction to the forces applied to connector 15*b* and, likewise, the forces applied to connector 15*c* are applied in a direction opposite to the compressive forces applied to connector 15*d*.

THE STEEL GIRDER CONSTRUCTION

In FIGS. 14–19, I have shown a construction in which the wood beams 10 and 11 are replaced by steel I-beams 31.

As FIG. 17 particularly illustrates, the shearing connectors, now generally designated 15', are formed of the same side plates 18 and transverse load applying web plates 20. There are no projections P, however, which extend downwardly and the plates 18 and 20 are simply welded or otherwise suitably secured to the top surface of the upper flanges of the beams 31. The side plates 18 are provided with the same openings 19 for capturing the ends of the rods 30 and embedding them in the concrete portions 29.

Except as indicated, the component parts of the building structure BS are all the same and have been accorded the same identifying letters and numerals. The plates 20 do not apply the shearing forces by end grain compression, as particularly illustrated in FIG. 7, but do transfer shearing forces to the steel beams 31 otherwise in the same general manner.

It is to be understood that other embodiments of the invention, which accomplish the same function, are incorporated herein within the scope of any ultimately allowed patent claims.

I claim:

1. In a reinforced concrete slab and girder building structure incorporating shearing connectors;

a. a concrete slab of predetermined width and length;

b. at least one slab support, underlying girder assembly having girders for receiving compressive load forces applied to said slab;

c. spaced apart support walls free-spanned by said girders and supporting said girders at widely spaced locations;

d. lengthwisely spaced shearing connectors at said wall locations spaced inboard of said walls, each of said connectors having at least a pair of transversely extending lengthwisely spaced rigid load transfer web plates secured between upstanding lengthwisely extending, transversely spaced side plate members in a position inset longitudinally from the ends thereof to provide end pockets between said web plates, said load transfer web plates and side plate members forming at least one enclosure longitudinally inboard of said end pockets, and being fixed by one of said girders to project upwardly from said one girder and be embedded in said slab, said slab including a concrete portion filling each said enclosure and said end pockets; and e. compression force transfer rebars supported by said side plate members to extend transversely from said side plate members in longitudinally spaced apart relation transversely between said web plates to transfer slab compressive forces to said web plates and girder.

2. The building structure of claim 1 wherein a wood deck is provided between said slab and girder, and said deck is cut out to accommodate said connector web plates and side plates, which protrude above said wood deck.

3. The building structure of claim 1 wherein said girder is a steel beam and said web plates and side plate members are fixed to the top of said steel beam.

4. In a reinforced concrete slab and girder building structure incorporating shearing connectors;

a. a concrete slab of predetermined width and length;

b. at least one slab support, underlying girder assembly having girders for receiving compressive load forces applied to said slab;

c. spaced apart support walls free-spanned by said girders and supporting said girders at widely spaced locations;

d. lengthwisely spaced shearing connectors at said wall locations spaced inboard of said walls, each of said connectors having at least a pair of transversely extending lengthwisely spaced generally vertical rigid load transfer web plates secured between upstanding lengthwisely extending, transversely spaced side plate members, said load transfer web plates and side plate members forming an enclosure, fixed by one of said girders to project upwardly from said one girder, and be embedded in said slab, said slab including a concrete portion filling each said enclosure; and e. compression force transfer members extending transversely in longitudinally spaced apart relation supported by said side plate members to transfer slab compressive forces to said web plates and girder;

said side plate members having lengthwisely spaced openings of a size and shape to accommodate the compression force transfer members which extend through said openings and embed in the concrete portions filling said enclosures, said compression force transfer members projecting laterally from said side plate members and including diagonal portions extending lengthwisely and widthwisely in said slab.

5. In a reinforced concrete slab and girder building structure incorporating shearing connectors:

a. a concrete slab of predetermined width and length;

b. at least one slab support, underlying girder assembly having girders for receiving compressive load forces applied to said slab;

c. spaced apart support walls free-spanned by said girders and supporting said girders at widely spaced locations;

d. lengthwisely spaced shearing connectors at said wall locations spaced inboard of said walls, each of said connectors having at least a pair of transversely extending lengthwisely spaced generally vertical rigid load transfer web plates secured between upstanding lengthwisely extending, transversely spaced side plate members, said load transfer web plates and side plate members forming an enclosure, fixed by one of said girders to project upwardly from said one girder, and be embedded in said slab, said slab including a concrete portion filling each said enclosure;

e. compression force transfer rebars extending from said side plate members transversely in longitudinally spaced apart relation supported by said side plate members to transfer slab compressive forces to said web plates and girder;

f. said load transfer web plates being inset from the ends of said side plate members and having web sections projecting below the ends of said side plate members, said side plate members also having downwardly projecting portions to function with the said web sections to form lengthwisely outwardly facing compartments; said one girder being a wood beam having pockets in its upper face snugly receiving said downwardly projecting web sections and downwardly projecting side plate portions; and a compression resistant, settable and hardenable material which does not shrink or expand filling said outwardly facing compartments and transferring the shear load imparted by said end plates longitudinally to the grain of said beam without slippage.

6. The building structure of claim 5 wherein said compartments have a bottom member fixed to said web sections to form the bottoms of said compartments.

7. The building structure of claim 6 wherein said settable and hardenable material is a grout.

8. The building structure of claim 6 wherein vertically extending fasteners extend from said bottom members into said wood beam to counter the bending couple set up by the forces applied.

9. In a method of constructing reinforced concrete slab and girder building structures incorporating shearing connectors with lengthwisely extending frame support parts to which lengthwisely spaced, transversely extending rigid load transfer plates affix, the steps of:

a. supporting a girder structure having one or more lengthwisely extending girders at widely spaced locations defining an unsupported span of girder between them;

b. affixing said connectors just inboard of each of said locations in widely spaced apart relation, the connectors being positioned so that the load transfer plates project above the girder structure;

c. providing a slab support deck on said girder structure, the deck having openings to pass said connectors;

d. mounting compression force transfer members having portions which extend outwardly from said connector and which have sections extending diagonally lengthwisely and widthwisely in said slab in lengthwisely spaced apart relation on said connector frame support parts transversely between said load transfer plates;

e. casting a concrete slab over said deck to embed the said load transfer plates and rebars therein; and f. curing said slab.

10. The method of claim 9 wherein said one or more girders are steel beams and said connector frame support parts and load transfer plates affix to the top thereof.

11. The method of claim 9 wherein said connector frame support parts each comprise a pair of lengthwisely extending side plates spanned by said load transfer plates which extend above said girder structure and are filled with concrete to function as a part of said slab.

12. In a method of constructing reinforced concrete slab and girder building structures incorporating shearing connectors with lengthwisely extending frame support parts to which lengthwisely spaced, transversely extending rigid load transfer plates affix, the steps of:

a. supporting a girder structure having one or more lengthwisely extending wood beam girders having pockets opening through their upper surface at widely spaced locations defining an unsupported span of girder between them;

b. affixing said connectors just inboard of each of said locations in widely spaced apart relation, the connectors being positioned so that the load transfer plates project above the girder structure, said load transfer plates having downwardly projecting portions extending into said pockets and bottoming portions connecting with said downwardly projecting portions;

c. applying vertically extending fasteners to extend through said bottoming portions into said beam; and d. filling said pockets with a compression resistant, settable and hardenable material which does not shrink or expand, and which functions to transfer loads longitudinally from said downwardly projecting portions of said load transfer plates perpendicularly to the grain of said wood;

e. providing a slab support deck on said girder structure, the deck having openings to pass said connectors;

f. mounting slab compression force transfer elements in spaced apart relation on said connector frame support parts to transfer load to said load-transfer plates;

g. casting a concrete slab over said deck to embed the said load transfer plates and compression force transfer elements therein; and h. curing said slab.

13. In a method of constructing reinforced concrete slab and girder building structures incorporating shearing connectors with lengthwisely extending frame support parts to which lengthwisely spaced, transversely extending rigid load transfer plates affix, the steps of:

a. supporting a girder structure having one or more lengthwisely extending wood beam girders at widely spaced locations defining an unsupported span of girder between them;

b. affixing said connectors lust inboard of each of said locations in widely spaced apart relation, the connectors being positioned so that the load transfer plates project above the girder structure, said connector support parts each comprising a pair of lengthwisely extending side plates and said load transfer plates being inset from the ends of said side plates, said load transfer plates having downwardly projecting portions extending below said side slates;

c. cutting pockets into the tops of said beams of a size to snugly receive said connector downwardly projecting portions;

d. inserting said connector downwardly projecting portions into said pockets; and e. filling said pockets with a compression resistant, settable and hardenable material, which does not shrink or expand to transfer shear loads endwisely to the wood grain;

f. providing a slab support deck on said girder structure, the deck having openings to pass said connectors;

g. mounting slab load transfer rebars in spaced apart relation on said connector frame support parts to project outwardly therefrom;

h. casting a concrete slab over said deck to embed the said load transfer plates and rebars therein; and i. curing said slab.

14. A shear connector for partial embedment in a concrete slab and for use to transfer compression loads in a concrete slab supported by an underlying girder structure directly to the girder structure through a deck supported by the girder structure, comprising;

a. a pair of lengthwisely extending side plates with a pair of generally vertical load transfer plates transversely spanning and rigidly affixed to the side plates inset from the ends thereof to form end pockets between said side plates and define compartment volume longitudinally inboard of said transfer plates; and b. connections on said side plates at lengthwisely spaced intervals for carrying slab-compression load transfer rebars thereon in longitudinally spaced relation transversely between said load transfer plates at a level to embed in said slab.

15. The connector of claim 14 in which said connections for the load transfer rebars are aligned openings in said side plates, and elongate rebar rods extend through said aligned openings and project outwardly from said side plates.

16. The shear connector of claim 15 wherein said load transfer plates project downwardly a substantial distance below said side plates to transfer compression forces endwisely, the load transfer plates having base plates with girder securement provided thereon.

17. The shear connector of claim 15 wherein said load transfer plates have portions which project downwardly a substantial distance below said side plates to transfer compression forces from the level of said side plates endwisely through said downwardly projecting portions.

18. A shear connector for partial embedment in a concrete slab and for use to transfer compression loads in a concrete slab supported by an underlying girder structure directly to the girder structure through a deck supported by the girder structure, comprising;

a. a lengthwisely extending horizontal frame comprising spaced apart lengthwisely extending plates having transversely extending, spanning, generally vertical load transfer plates rigidly attached thereto; and b. load transfer rebar connectors on said frame between said load transfer plates comprising a series of lengthwisely spaced elongate rebars extending through and projecting laterally from said frame, said rebar connectors having generally diagonal portions to extend lengthwisely and widthwisely in said slab outward of said frame.

19. A method of constructing a shearing connector for embedment in a concrete slab and for use to transfer loads to an underlying girder comprising the steps of:

a. providing a lengthwisely extending horizontal steel frame part;

b. rigidly fixing steel load transfer plates to said frame part to extend transversely relative thereto from the ends of said frame part; and c. machining lengthwisely spaced holes in said frame part between said load transfer plates through which rebars which embed in said slab can snugly extend.

20. The method of claim 19 including the step of inserting said rebars in said openings.

21. In a reinforced concrete slab and girder building structure incorporating shearing connectors;

a. a concrete slab of predetermined width and length;

b. a deck beneath said slab;

c. at least one slab support wood beam girder, having an upper face formed with pocket space therein, for supporting said deck and to receive compressive load forces applied to said slab;

d. a compression load transfer shearing connector for each end of said girder having at least a pair of transversely extending, lengthwisely spaced, vertical rigid load transfer web plates secured between upstanding, lengthwisely spaced, side plate members, said load transfer web plates and side plate members forming an enclosure between said web plates and said side plate members, said connectors being fixed by said girder to project upwardly from said girder through said deck, said web plates also extending down into said pocket space and cooperating with cured compression resistant hardenable material filling said pocket space to transfer shearing load to the end grain of the wood beam girder, the connector enclosure being embedded in said slab to transfer compression loads to said web plates, and the slab having a concrete portion filling said enclosure.

22. The building structure of claim 21, wherein said side plate members have lengthwisely spaced openings of a size and shape to snugly accommodate rebars which extend through said openings and embed in said slab.

23. The structure of claim 21 wherein bottoming plates connect to the lower ends of said web plates and fasteners secure said bottoming plates to said beam to counteract couple moments.

24. The structure of claim 21 wherein elongate load transfer members mount on said side plates between said load transfer plates to extend transversely between said side plates, the members projecting laterally outwardly from said side plates and having generally diagonal portions extending lengthwisely and widthwisely in said slab.

25. In a method of constructing reinforced concrete slab and girder building structures incorporating compression load transfer shearing connectors with lengthwisely extending frame support parts to which lengthwisely spaced, transversely extending rigid generally vertical load transfer plates affix, the steps of:

a. supporting a girder structure having one or more lengthwisely extending wood beam girders with lengthwisely spaced apart pockets opening through their upper surface, at widely spaced locations defining an unsupported span of girder between them;

b. mounting said connectors just inboard of each of said locations in widely spaced apart relation, the connectors being positioned so that the load transfer plates have upper portions which project above the girder structure, said load transfer plates having downwardly projecting portions which are extended into said pockets;

c. filling said pockets with a compression resistant, settable and hardenable material which does not shrink or expand, and which functions to transfer loads longitudinally from said downwardly projecting portions of said load transfer plates perpendicularly to the grain of said wood, and curing said material;

d. casting a concrete slab to embed the said upper portions of the load transfer plates therein; and e. curing said slab.

26. The method of claim 25 wherein bottoming plates connect to the lower ends of said load transfer plates and, when said connectors are mounted, fasteners are applied to vertically extend through said bottoming plates into said beam.

27. The method of claim 25 comprising mounting elongate load transfer members on said frame support parts between said load transfer plates to extend transversely between said frame support parts, the members projecting laterally outwardly from said side plates and having generally diagonal portions extending lengthwisely and widthwisely in said slab.

28. In a concrete slab and girder building structure incorporating shear force connectors:

a. a generally horizontal concrete slab extending widthwisely and lengthwisely;

b. at least one generally horizontal slab support wood beam girder having an upper face formed with pocket spaces therein;

c. a compression force load transfer shearing connector for each end of said girder embedded in said slab and having at least a pair of transversely extending, lengthwisely spaced, generally vertical rigid load transfer plates having upper portions embedded in said slab and lower portions received in said pockets; and d. cured compression resistant material filling said pockets to transfer shearing load to the end grain of the wood beam girder.

29. The structure of claim 28 wherein spaced apart vertical side plates mount said load transfer plates and wherein elongate load transfer members extend between said side plates and project laterally outwardly therefrom into said slab, the load transfer members having generally diagonally extending portions extending widthwisely and lengthwisely in said slab.

* * * * *

UNITED STATES PATENT AND TRADEMARK OFFICE

CERTIFICATE OF CORRECTION

PATENT NO. : 5,809,722

DATED : September 22, 1998

INVENTOR(S) : Peter Bertsche

It is certified that error appears in the above-indentified patent and that said Letters Patent is hereby corrected as shown below:

Column 6, line 5, after "load" insert -- transfer --.

Column 10, line 8, "lust" should be -- just --.

Signed and Sealed this

Nineteenth Day of January, 1999

*Attest:*

*Attesting Officer*

*Acting Commissioner of Patents and Trademarks*